US007998031B2

(12) United States Patent
Dumke et al.

(10) Patent No.: US 7,998,031 B2
(45) Date of Patent: Aug. 16, 2011

(54) EXERCISE DEVICE FOR AQUATIC USE

(76) Inventors: Sharon Dumke, Norristown, PA (US); Joanne Randell, Downingtown, PA (US)

( * ) Notice: Subject to any disclaimer, the term of this patent is extended or adjusted under 35 U.S.C. 154(b) by 0 days.

(21) Appl. No.: 11/529,032

(22) Filed: Sep. 28, 2006

(65) Prior Publication Data

US 2008/0081742 A1 Apr. 3, 2008

(51) Int. Cl.
*A63B 31/00* (2006.01)

(52) U.S. Cl. ..... 482/55; 441/129; 472/129

(58) Field of Classification Search ..... 482/38, 482/55, 111, 148, 16, 33, 106; D21/803, D21/678; 441/129–134, 136, 44, 45, 55; 472/128, 129; 434/254

See application file for complete search history.

(56) References Cited

U.S. PATENT DOCUMENTS 2,009,551 A * 7/1935 Huebner ..... 441/56
3,719,185 A * 3/1973 Hanes ..... 606/240
3,861,683 A * 1/1975 Henry ..... 473/604
4,253,673 A * 3/1981 Bailey ..... 473/596
4,458,896 A * 7/1984 Solloway ..... 482/111
4,768,774 A * 9/1988 Beasley ..... 482/111
4,878,311 A * 11/1989 Cano ..... 43/54.1
4,923,187 A * 5/1990 Mombrinie ..... 5/648
4,928,977 A * 5/1990 Chambers ..... 473/569
4,993,980 A * 2/1991 Dulin et al. ..... 441/129
5,000,710 A * 3/1991 Bedortha et al. ..... 441/129
5,004,226 A 4/1991 Brown, Jr.
5,184,993 A * 2/1993 Dowdeswell ..... 482/106
5,190,512 A 3/1993 Curran
5,203,753 A * 4/1993 Rothhammer ..... 482/111
5,266,069 A * 11/1993 Thorne ..... 482/111
5,316,531 A * 5/1994 Spence ..... 482/93
5,385,521 A * 1/1995 Weissbuch ..... 482/55
5,514,059 A 5/1996 Romney
5,824,013 A * 10/1998 Allen ..... 606/240
5,941,806 A * 8/1999 Olschansky et al. ..... 482/140
6,293,893 B1 9/2001 Truchelut
6,386,988 B1 5/2002 Shearer et al.
6,475,126 B1 * 11/2002 Hay, Jr. ..... 482/131
6,508,749 B1 1/2003 Broadwater
6,685,518 B1 * 2/2004 Goudey ..... 441/1
6,712,658 B1 * 3/2004 Crossley et al. ..... 441/106
6,749,475 B2 * 6/2004 Howerton ..... 441/132
6,764,456 B1 7/2004 Doherty
6,872,174 B2 3/2005 Benach
6,887,186 B2 * 5/2005 Bambanian ..... 482/55
7,090,618 B2 * 8/2006 Stout et al. ..... 482/55
7,101,241 B2 * 9/2006 Monroe ..... 441/129
7,108,646 B1 * 9/2006 Quick ..... 482/148
7,108,846 B1 * 9/2006 Marchand et al. ..... 424/9.33
7,184,363 B2 * 2/2007 Szegedi et al. ..... 367/3
D583,006 S * 12/2008 Hennings, III ..... D21/803
2002/0009934 A1 * 1/2002 Watler ..... 441/129
2004/0082449 A1 4/2004 Brown, Jr.
2005/0106963 A1 * 5/2005 Ross ..... 441/129
2007/0072499 A1 * 3/2007 Hennings, III ..... 441/129

* cited by examiner

*Primary Examiner* — Loan Thanh
*Assistant Examiner* — Tam Nguyen
(74) *Attorney, Agent, or Firm* — RatnerPrestia

(57) ABSTRACT

A device and method of use for the same adapted for aquatic exercise. The device includes an inner member and an outer foam member, each having a length much greater than its respective average outside diameters and both the inner member and an outer foam member having approximately the same length. The inner member adapted to be water-tight and being located substantially within the outer foam member. Where the inner member is more rigid than said outer foam member.

1 Claim, 5 Drawing Sheets

EXERCISE DEVICE FOR AQUATIC USE

BACKGROUND OF THE INVENTION

The invention relates generally to a general physical conditioning or a physical rehabilitation device. More particularly, the invention relates to an exercise device for aquatic exercises which provides resistance to a user in an aquatic environment, thereby enabling a user to more efficiently strengthen or rehabilitate muscles while performing aquatic exercises, and to a method of use for such a device.

An aquatic exercising device provides resistance against which the user exerts force during exercising while in an aquatic environment such as a swimming pool or other body of water. Aquatic exercises have increased in popularity because water exercises increase heart rate and oxygen uptake and improve muscle tone without the shock of exercising/impacting on a hard surface.

In the past, there have been pool toys such as those typically called "water noodles" which have some degree of buoyancy in water and thus allow a swimmer to support his or her body weight by laying across the pool toy, for example with the pool toy held under the arms of the swimmer. The "water noodle" is typically a highly flexible cylindrical tube 3 to 4 inches in diameter and 3 to 6 feet in length, typically made of an open or closed cell foam with a hollow interior. Thus, it is an elongated, highly flexible device which tends to bend about the swimmer's body or to bend into a "U" shape when it is used for buoyancy or aquatic activity. Due to the flexibility of the "water noodle," it is not possible for the it to provide a sufficient resistance to achieve the improved benefits in aquatic exercise provided by the present invention.

An additional problem with many other exercise devices is their complicated designs, which are therefore expensive to manufacture. The present device is made from readily available materials and is inexpensive and is easy to manufacture.

Many other exercise devices are not properly designed to be used in an aquatic environment or as aquatic exercise tools. That is, many other exercise devices lack sufficient buoyancy to be used in an aquatic environment, are too hydrodynamic to provide resistance in an aquatic environment, are too flexible to provide sufficient resistance or stabilization for aquatic exercise, and/or are susceptible to deterioration from harsh pool chemicals or prolonged exposure to water.

From the foregoing, it will be appreciated that what is needed in the art is a versatile exercising device which is specifically adapted for aquatic use, one that flexes, but is rigid enough to provide sufficient resistance and stabilization when used for aquatic exercises.

SUMMARY OF THE INVENTION

The current invention is for an aquatic exercise device and a method for using said device for aquatic exercise and/or therapy. Very generally the device comprises an elongated hollow relatively inflexible inner tubular member which is water-tight, surrounded and retained throughout its length by an outer foam member which is relatively more flexible and made of a suitable open or closed cell foam.

More particularly the invention may be described as comprising:

an inner tubular member with an exterior wall and hollow interior cavity, said inner tubular member having a length much greater than its average diameter, said inner member having a proximal end and a distal end, and said proximal end and distal end of the inner member being water-tight;

an outer foam member with an exterior wall and an interior channel, having approximately the same length as said inner tubular member, and said channel of the outer foam member having approximately the same shape and dimensions as the exterior wall of the inner member;

said inner tubular member being more rigid than said outer foam member; and said inner tubular member being located substantially within and retained by the channel of the outer foam member.

BRIEF DESCRIPTION OF THE DRAWINGS

A more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE INVENTION

Figure 1:
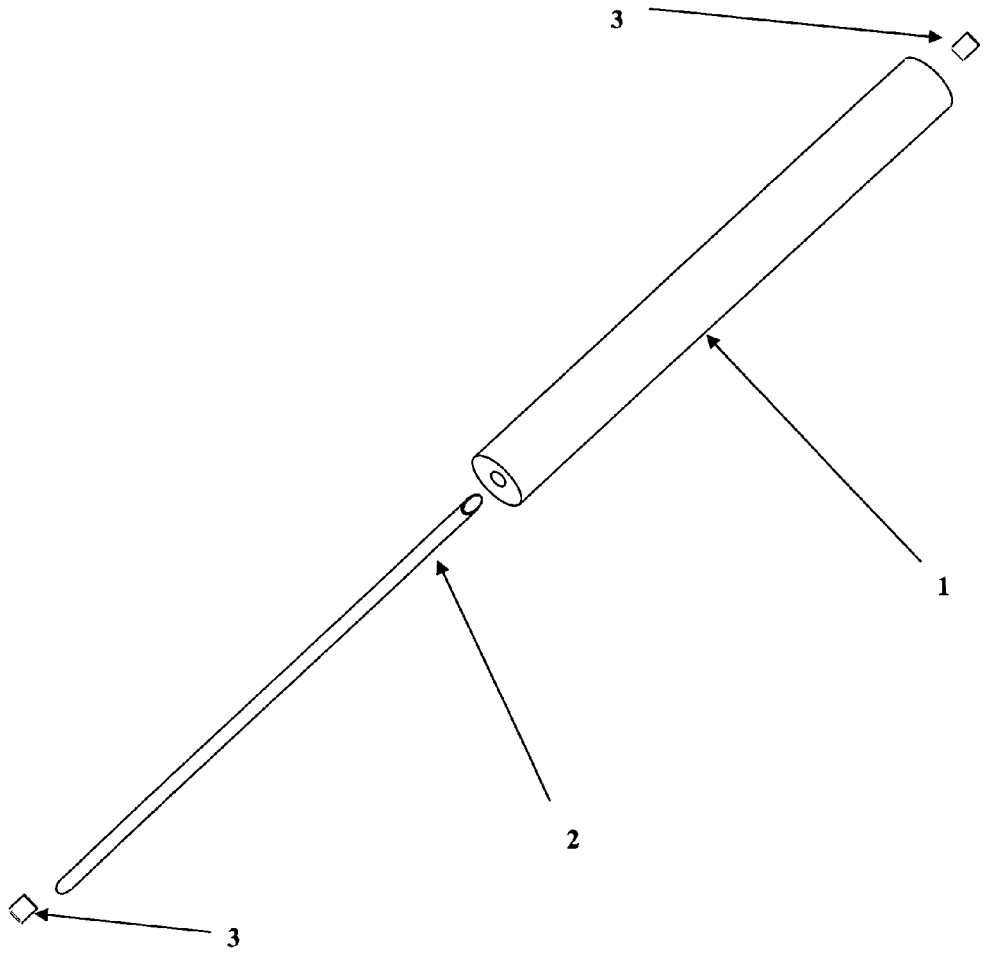
FIG. 1 is an exploded view of the invention showing the disassembled individual elements of the claimed invention.

The present invention comprises a device for use in aquatic exercise, aquatic therapy, or both, which provides sufficient buoyancy, resistance, and stabilization when utilized for exercise or therapy in an aquatic environment. The present invention also comprises a method for improved, resistive aquatic exercise or aquatic therapy comprising aquatic use of the device for resistive aquatic exercises.

Thus, the present invention provides an aquatic exercise device comprising an elongated, buoyant, tubular structure having a flexible outer foam member, an interior wall of which defines and fully surrounds an interior hollow interior channel extending throughout the length of the outer foam member, and an inner tubular member retained in the interior channel. Each such member has a length much greater than its width or diameter. The inner member is sealed to render its internal cavity water tight, such that air is trapped inside the inner member and adds to the buoyancy of the aquatic exercise device as a whole.

The outer foam member is approximately the same length as the inner member and radially surrounds the inner member through substantially the entire length of the inner member. The outer foam member is a hollow foam member, suitably a hollow cylindrical tube. However, the cross-sectional shape of the outer foam member may be different (i.e., oval, hexagonal, square, irregular). The hollow interior channel of the outer foam member is defined by the interior body wall of the outer foam member and has approximately the same shape and dimensions as the exterior of the inner member.

The outer foam member is more flexible than the inner member. The inner member, while not required to be completely rigid, is more rigid than the outer foam member. It is sufficiently rigid to permit flexing but prevent bending when the device moves through water at a pace normally used for aquatic exercise.

The inner member is located and retained substantially within the hollow interior channel of the outer foam member that is defined by the interior wall of the outer foam member. Thus, the outer foam member surrounds the inner member throughout its length. The inner member may be held in place within the outer foam member by a number of means as described more fully below.

In another aspect of the invention, a method is provided in which the exercise device is used in an aquatic exercise program. The method of using the aquatic exercise device increases the force of buoyancy, increases range of motion, increases trunk and core musculature strength, increases lower and upper extremity strength, serves as a stable floatation device allowing for proper technique of vertical and floating exercises in the aquatic medium, increases propioceptive responses that improve appropriate muscle recruitment, and improves the specificity of aquatic exercise protocols.

These and other features and advantages of the present invention will become more fully apparent from the following description and appended claims, or may be learned by the practice of the invention as set forth hereinafter.

Specifically, the present invention relates to an aquatic exercise device that provides sufficient buoyancy and resistance to movement through water to provide increases in range of motion, increases in trunk and core musculature strength, increases in lower and upper extremity strength, to serve as a stable floatation device allowing for proper technique of vertical and floating exercises in the aquatic medium, and to provide an increase in propioceptive responses that improve appropriate muscle recruitment and therefore improve specificity of exercise protocols in the water.

Due to the rigid characteristic of the invention, the device exhibits improved versatility over existing aquatic therapy devices, increasing the exercise combinations and benefits which may be obtained from aquatic therapy. Additionally, stabilization of the participant is increased due to the increase in buoyancy of the design over prior art. This increases the potential for improved exercise technique, and additionally offers non-swimmer and fearful participants, including geriatric users, the ability to exercise more safely and benefit from the exercise prescription.

FIG. 1 shows an exploded view of the basic elements of one embodiment of the invention. In FIG. 1, an outer foam member (1) is shown together with an inner tubular member (2), and end caps (3) for sealing the ends of member (2) to render it water-tight. In the final assembly, the inner tubular member, which is sealed by any suitable means, and occupies and is retained within a hollow central channel running the length of foam member (1).

Foam is a lightweight, versatile, polymer-based material. The base foam material, such as plastic or polyurethane, is "frothed up" while in a molten state and then cooled, which fills the material with countless little bubbles, giving it an appearance similar to a sponge. Foams are typically classified into two categories: open-cell and closed-cell. In closed-cell foam, each little air pocket, or cell, is completely enclosed by a thin wall. Closed cell foams are desirable for the present invention because they tend to limit absorption of water which would tend to increase weight and reduce buoyancy of the device in an aquatic environment. In open-cell foams the individual cells are interconnected and more susceptible to absorption of water. However, the absorption of water may be regulated with either of these foams by regulating the size of the individual pores or cells and/or by coating the exposed surfaces of the outer foam material. Such adaptations will be readily apparent to those skilled in the foam production art.

The foam is typically resistant to excessive water absorption and harsh pool chemicals and has good tear resistance, tensile strength, and resiliency, making the outer foam member (1) able to endure bending, twisting, and abuse. Additionally, similar lightweight, buoyant foam or foam-like materials to make the outer foam member will be apparent to one skilled in the art. The material for the outer foam member (1) may suitably be a closed-cell polyethylene foam. In one illustrative embodiment, the outer foam member (1) is made of Ethafoam® and has an outer diameter (10) of about 3 inches and a length (8) of about 54 inches.

Figure 3:
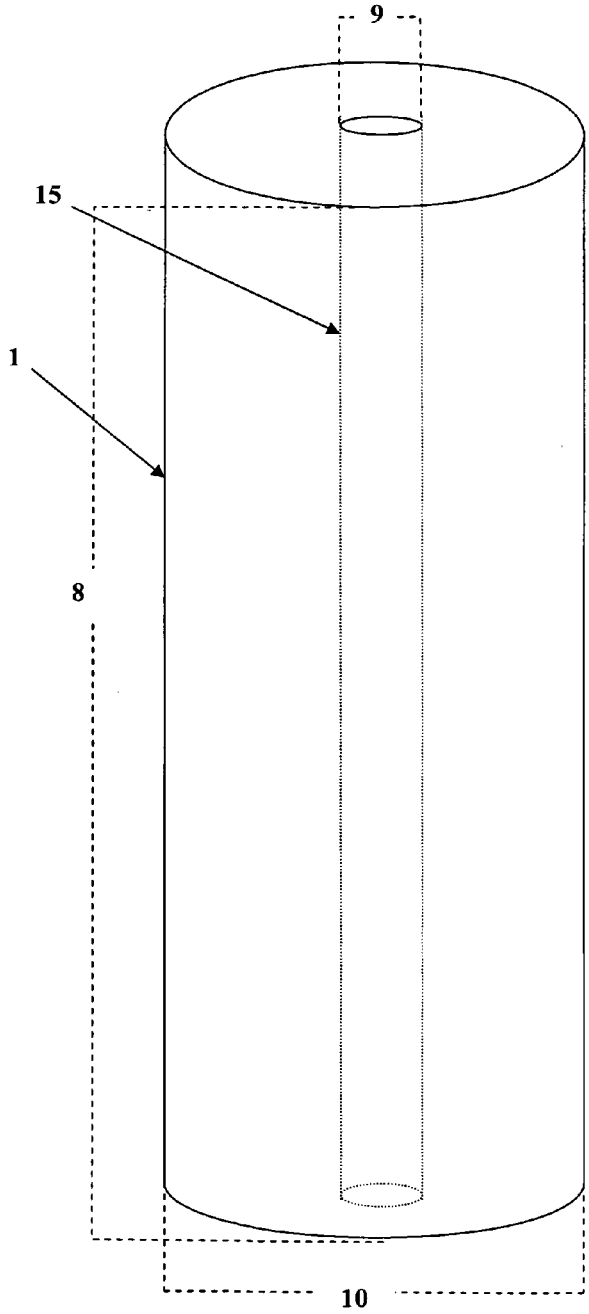
FIG. 3 is a side view of the outer foam member.

The outer foam member (1) is shown in greater detail in FIG. 3. FIG. 3 clearly shows that the length (8) of the outer foam member (1) is much greater than the width or diameter (10) of the outer foam member (1). For example the inner and outer members may each have a length in the range of about 3 to about 6 feet, for example, around 4 feet. Additionally, FIG. 3 and FIG. 7 both show the relative relationship between the diameter (9) of the channel (15) of outer foam member (1) and the outer diameter (10) of the outer foam member (1).

Figure 8:
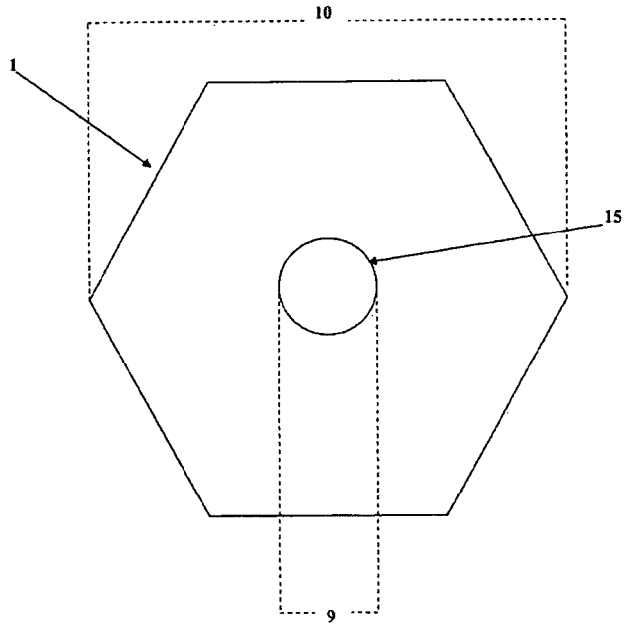
FIG. 8 shows an end view of another embodiment of the outer foam member.

Referring to FIG. 8, another embodiment of the invention is shown, in which a hexagonal embodiment of the outer foam member (1) is utilized. As additionally indicated in FIG. 8, it is not necessary for the cross-sectional shape of the exterior of the outer foam member (1) to be the same as the cross-sectional shape of the interior channel thereof, even though this may be the case in some instances.

Figure 10:
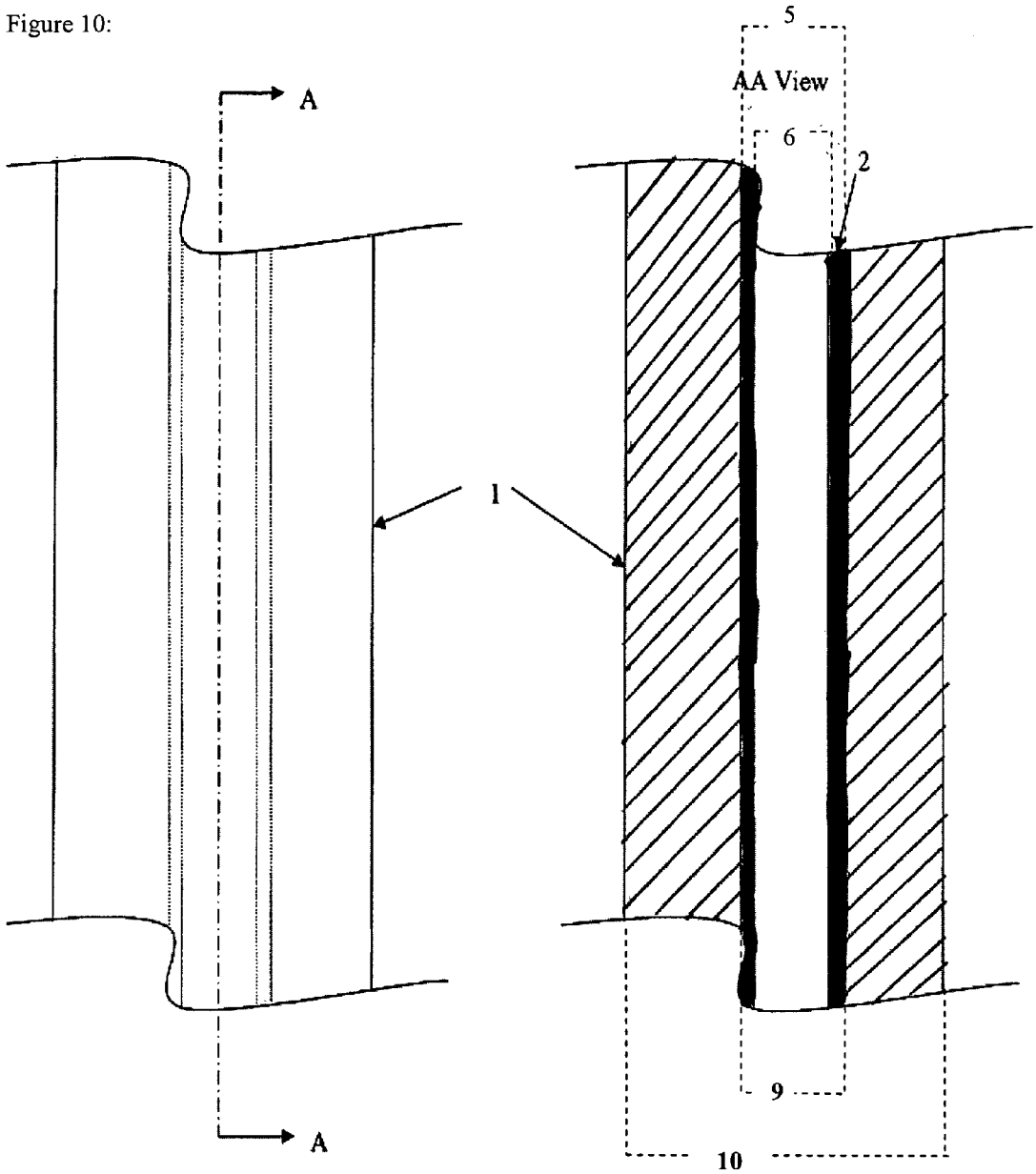
FIG. 10 shows a longitudinal cross sectional view of a portion of one embodiment of the claimed invention.

Although it will be apparent that a wide range of values are acceptable for the inner diameter (9) of channel (15) and outer diameter (10) of the outer foam member (1), a suitable ratio of the outer diameter (10) to the inner diameter (9) is greater than about 2:5:1, for example, in the range of about 2.5:1 to about 5:1. Stated otherwise, the outer diameter or cross-section of foam member (1) may be in the range of about 2 to about 4 inches. Likewise the diameter or cross-section of the inner channel of foam member (1) corresponds to the outer diameter of the inner tubular member, such that the tubular member may be retained within the hollow cavity. This can be seen in FIG. 10, in which the inner diameter (9) of the outer foam member (1) is equal to the outer diameter (5) of the inner member (2). Suitably the diameter of the hollow channel within foam member (1) may be in the range of about 0.5 inches up to about 1.5 inches, with the inner tubular member having a corresponding cross-sectional outer dimension. Thus the outer diameter of foam member (1) is substantially greater than diameter of the channel of foam member (1), such that the thickness of the wall of foam member (1) is at least as large as the diameter of the channel (15) thereof.

Figure 2:
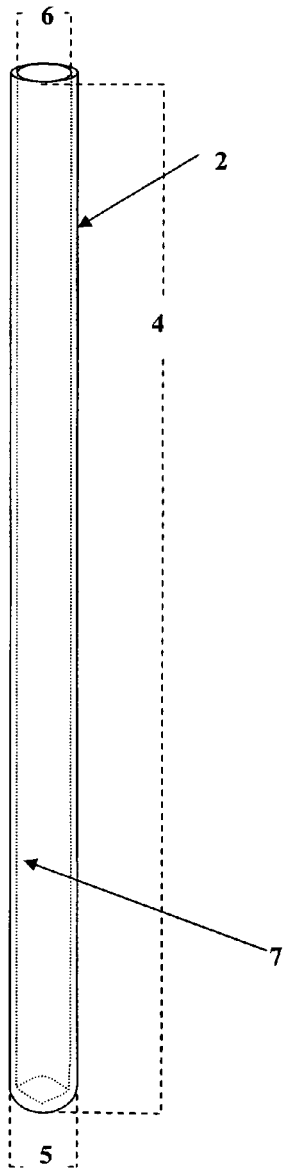
FIG. 2 is a side view of the inner member.
Figure 9:
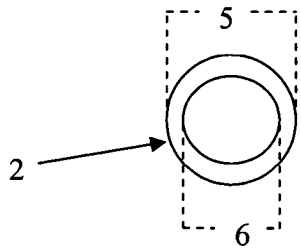
FIG. 9 shows an end view of one embodiment of the inner member.

Referring again to FIG. 1, there is shown the inner member (2). The inner member (2) is shown in greater detail in FIG. 2. Additionally, an end view of the inner member is shown in FIG. 9. Like the outer foam member (1), the inner tubular member (2) has a length (4) much greater than its outer width or diameter (5). However, unlike the outer foam member (1), the inner member (2) has an outer width or diameter (5) that is not substantially larger than its inner width or diameter (6). This gives the inner member (2) a comparably thinner wall (7) when compared to the outer foam member (1). A typical is thickness value for the wall (7) is about ⅛". However, a wide variety of thicknesses could be used for the wall (7) of the inner member (2) so long as, when adapted to be water-tight, the inner member (2) maintains a positive buoyancy. Additionally, the cross-sectional shape of the inner member (2) may be cylindrical or any of a number of other shapes (i.e., hexagonal, oval, square, etc.) without affecting the utility of the invention. Cost-wise, from a production standpoint, the shape of choice is probably cylindrical.

The inner member (2) may be made from a wide variety of materials so long as it is more rigid than the outer foam member (1), will flex but not bend easily or excessively, and, when adapted to be water-tight, the inner member (2) maintains a positive buoyancy. A suitable material for the inner member (2) of the present invention is polyvinyl chloride, commonly referred to as PVC.

As roughly indicated in FIG. 1, the lengths (4, 8) of the inner member (2) and the outer foam member (1) should be approximately equal. The length of the inner member (4) is more clearly shown in FIG. 2 and the length of the outer foam member (8) is more clearly shown in FIG. 3.

Figure 4:
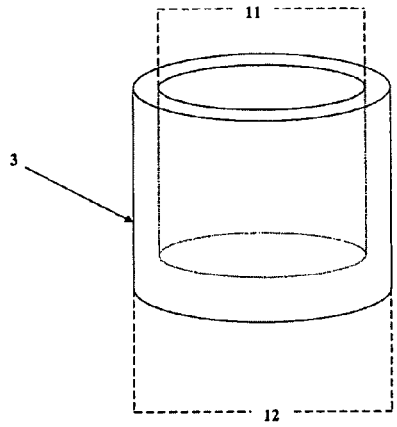
FIG. 4 is a side view of one embodiment of an end cap for the inner member.
Figure 5:
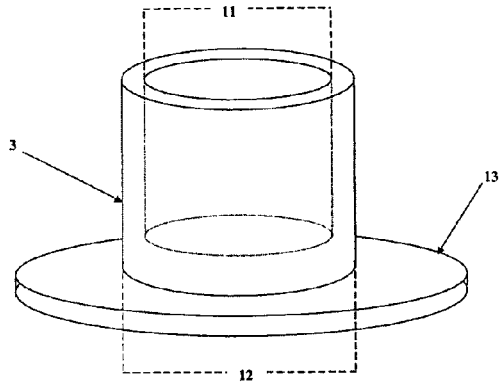
FIG. 5 is a side view of another embodiment of an end cap for the inner member.
Figure 6:
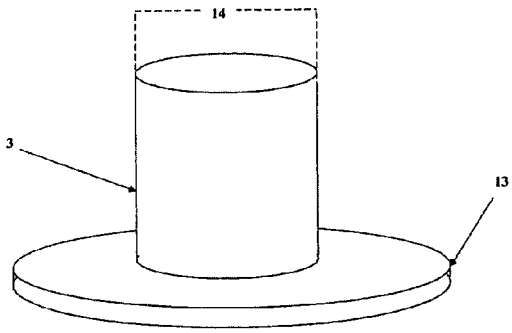
FIG. 6 is a side view of yet another embodiment of an end cap for the inner member.

As mentioned above, the inner member (2) should be buoyant when its ends are capped or sealed to render it water-tight. There are many potential methods for making the inner member (2) water-tight in accordance with the instant invention. Some options include inserting a stopper or other material into the proximal and distal ends of the inner member (2) or sealing the opposing outer walls (7) of the inner member (2) to each other, thermally, mechanically, or otherwise. In one method, end caps (3) may be affixed either permanently or removeably to the proximal and distal ends of the inner member (2). Some examples of these end caps (3) are shown in FIGS. 4, 5, and 6. The end caps (3) may be removeably affixed through a number of methods including the use of threaded portions of the end caps (3) and corresponding threaded portions of the inner member (2). Another method of removeably affixing the end caps (3) to the inner member (2) is by ensuring that there is a snug fit, such as a friction fit, between the end caps (3) and the inner member (2) such that there is a water-tight seal and friction between the end caps (3) and the inner member (2) that will hold the end caps (3) in place. Other methods of removeably affixing the end caps (3) to the inner member (2) will be readily apparent to those skilled in the art.

One embodiment of an end cap (3) is shown in FIG. 4. This end cap (3) has an internal diameter (11) that is sized to fit over the outer diameter (5) of the inner member. Additionally this end cap (3) has an outer diameter (12) that is approximately equal to or slightly less than the inner diameter (9) of the outer foam member. This allows the end cap (3) to fit snugly inside the outer foam member (1) when the end cap (3) is affixed to the inner member (2) and the inner member (2) is place within the outer foam member (1).

Another embodiment of an end cap (3) is shown in FIG. 5. This end cap (3) has an internal diameter (11) that is sized to fit over the outer diameter (5) of the inner member. Additionally this end cap (3) has an outer diameter (12) that is approximately equal to or slightly less than the inner diameter of the outer foam member (9). This allows the end cap (3) to fit snugly inside the outer foam member (1) when the end cap (3) is affixed to the inner member (2) and the inner member (2) is place within the outer foam member (1). Additionally, this end cap (3) has a flange (13) that extends beyond the end cap's outer diameter (12), the cross-section of which is greater than the cross-section of the hollow channel of the outer foam member but is suitably less than or equal to the cross-section (10) of the outer foam member. This flange (13) will prevent the inner member (2) from becoming dislodged from the inside of the outer foam member (1) once the end cap (3) is affixed to the inner member (2) within the outer foam member (1).

Yet another embodiment of an end cap (3) is shown in FIG. 6. This end cap (3) has an external diameter (14) that is sized to fit within the inner diameter of the inner member (6). Additionally, this end cap (3) has a flange (13) as described above that extends beyond the end cap's outer diameter (12). This flange (13) will prevent the inner member (2) from becoming dislodged from the inside of the outer foam member (1) once the end cap (3) is affixed to the inner member (2) within the outer foam member (1).

Figure 7:
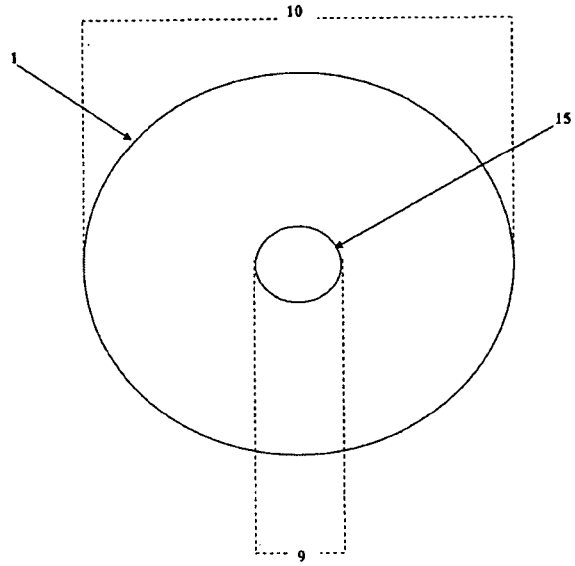
FIG. 7 shows an end view of one embodiment of the outer foam member.

As mentioned above, the inner member (2) is located substantially within the hollow interior channel of the outer foam member which is defined by the interior body wall (15) of the outer foam member (1), as shown in FIGS. 7, and 8. The location of the inner member (2) within the hollow interior channel defined by interior body wall (15) of the outer foam member can be maintained through many different approaches. Note that while it is acceptable for the inner member (2) to be readily removable from within the hollow interior channel of the outer foam member, the inner member (2) should not easily fall out during normal exercising or handling of the device. Among the methods of retaining the inner member (2) within the hollow interior channel of the outer foam member is the use of end caps (3) such as those described in FIGS. 5 and 6 which use a flange (13) to mechanically maintain the position of the inner member (2). Additionally, friction may hold the inner member (2) within the hollow interior channel of the outer foam member such as through using an end cap (3), as shown in FIG. 4, that fits snugly within the hollow interior channel of the outer foam member or by using an inner member (2) with an outer diameter (5) close enough in size to the inner diameter of the channel within the outer foam member (9) that the entire inner member (2) fits snugly within the hollow interior channel of the outer foam member. Other methods for maintaining the inner member (2) within the hollow interior channel of the outer foam member include but are not limited to: thermal bonding between the inner member (2) and the outer foam member (1); applying adhesive to any one or more of the adjacent surfaces of inner member (2), outer foam member (1), or end cap(s) (3); using vibration welding; and other methods known to those skilled in the art.

A method of for aquatic exercise and/or therapy is also contemplated and within the scope of the present invention, usage of the claimed aquatic exercise device is employed in resistive exercise in an aquatic environment to provide increases in range of motion, increases in trunk and core musculature strength, increases in lower and upper extremity strength, to serve as a stable floatation device allowing for proper technique of vertical and floating exercises in the aquatic medium, and to increase in propioceptive responses that improve appropriate muscle recruitment and therefore improve specificity of exercise is protocols in the water.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method of improving trunk or core musculature strength of an exercise participant in an aquatic environment, the method comprising the steps of:

using a tubular apparatus in an aquatic environment, the tubular apparatus having a substantially constant buoyancy along an entire length of the tubular apparatus, the apparatus comprising:

a generally straight and substantially rigid inner tubular member with an exterior wall, hollow interior cavity, and water-tight ends, the inner member having a length much greater than its diameter, a buoyant outer foam member substantially surrounding the hollow inner tubular member, the buoyant outer foam member having a substantially constant diameter along the entire length of the tubular apparatus, and the inner member being more rigid than the outer foam member but having sufficient flexibility to allow flexing when the apparatus moves through water during exercise;

Stabilizing oneself with the tubular apparatus in the aquatic environment using the buoyancy of the tubular apparatus; and performing at least one vertical or floating exercise for improving trunk or core musculature strength with the tubular apparatus in the aquatic environment

* * * * *